United States Patent [19]

Harvey et al.

[11] Patent Number: 4,706,887

[45] Date of Patent: Nov. 17, 1987

[54] FUEL INJECTION NOZZLES

[75] Inventors: David M. Harvey, Glemsford; Charistopher J. Moody, Worthing, both of England

[73] Assignee: Lucas Industries public limited company, Birmingham, England

[21] Appl. No.: 864,755

[22] Filed: May 14, 1986

Related U.S. Application Data

[63] Continuation of Ser. No. 603,701, Apr. 25, 1984, abandoned.

[30] Foreign Application Priority Data

May 19, 1983 [GB] United Kingdom ..... 8313903

[51] Int. Cl.[4] ..... B05B 1/32

[52] U.S. Cl. ..... 239/453; 239/533.9

[58] Field of Search ..... 239/533.3–533.12, 239/453, 584

[56] References Cited

U.S. PATENT DOCUMENTS

| | | | |
|---|---|---|---|
| 3,243,127 | 3/1966 | Watson | 239/453 |
| 3,460,760 | 8/1969 | Bluhm | 239/584 X |
| 4,164,326 | 8/1979 | Deckard | 239/453 X |
| 4,375,274 | 3/1983 | Thoma et al. | 239/533.12 X |
| 4,410,141 | 10/1983 | Seifert | 239/453 |

FOREIGN PATENT DOCUMENTS

| | | | |
|---|---|---|---|
| 2371583 | 7/1978 | France | 239/533.9 |
| 191306 | 8/1937 | Switzerland | 239/533.3 |

*Primary Examiner*—Andres Kashnikow
*Assistant Examiner*—Daniel R. Edelbrock

[57] ABSTRACT

A fuel injection nozzle for supplying fuel to an internal combustion engine includes a valve member biased by a spring against the action of fuel under pressure supplied to an inlet. A further spring acts in opposition to the first mentioned spring through a piston like push piece. The fuel pressure also acts upon the push piece in opposition to the force exerted by the further spring and the extent of movement of the push piece under the action of the further spring is limited.

5 Claims, 2 Drawing Figures

FUEL INJECTION NOZZLES

This application is a continuation of application Ser. No. 603,701, filed Apr. 25, 1984 now abandoned.

This invention relates to fuel injection nozzles for supplying fuel to compression ignition engines the nozzles being of the kind comprising a resiliently loaded fuel pressure actuated valve member which is urged into sealing engagement with a seating by the resilient loading provided by a resilient means, and is lifted from the seating by the action of fuel under pressure supplied to an inlet, to allow fuel flow to an outlet.

Such nozzles are well known in the art. In order to improve the operation of an associated engine it is necessary to control the lift of the valve member away from its seating so that the pressure at the inlet which is required to move the valve member increases during the movement of the valve member from the seating. This can be achieved by the provision of an additional resilient means which is either effective to resist movement of the valve member after the valve member has moved a predetermined distance from the seating or alternatively is arranged to oppose the action of the first mentioned resilient means until the valve member has moved said predetermined distance.

The disadvantage of such an arrangement is that there is a sudden increase in the force acting upon the valve member after it has moved said predetermined distance and the resulting operating characteristics of the nozzle may not be ideal so far as the engine is concerned.

The object of the invention is to provide a fuel injection nozzle of the kind specified in a simple and convenient form.

According to the invention a fuel injection nozzle of the kind specified comprises further resilient means acting on the valve member in opposition to said first mentioned resilient means, and piston means exposed to the fuel under pressure at said inlet, the force exerted by the fuel under pressure on said piston means acting to oppose the force exerted by said further resilient means.

Figure 1:
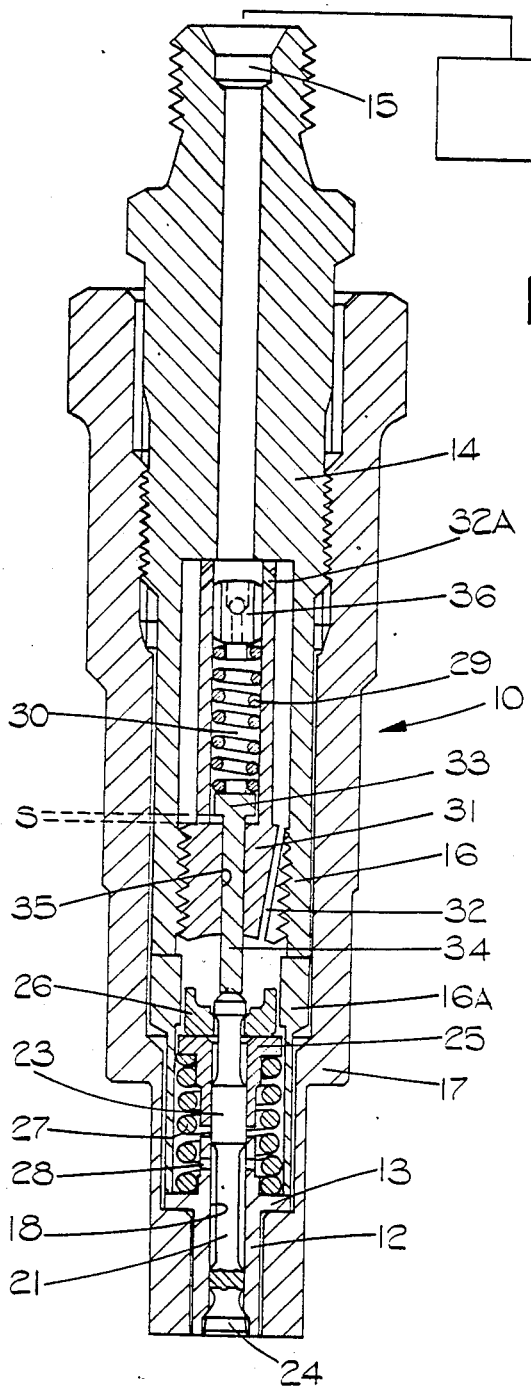
Figure 2:
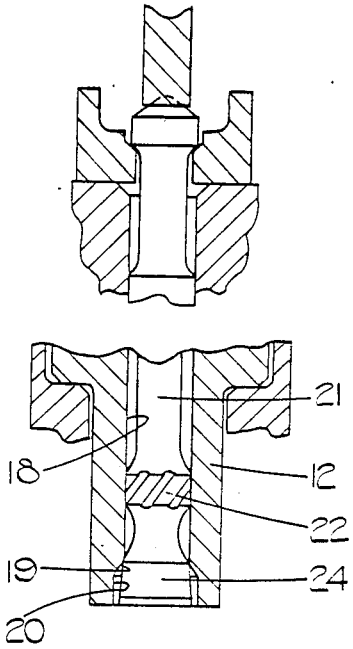

An example of a fuel injection nozzle in accordance with the invention will now be described with reference to the accompanying drawings FIG. 1 of which shows the nozzle in sectional side elevation and FIG. 2 shows to an enlarged scale, part of the nozzle of FIG. 1.

Referring to the drawing the nozzle is generally indicated at 10 being of the so-called outwardly opening type and fuel is supplied to the nozzle by means of fuel injection pump 11. The nozzle comprises a valve body 12 which is of generally cylindrical form and which is provided with a peripheral flange 13. The nozzle also includes a hollow body portion 14 which at one end defines a fuel inlet 15 which is connected to the outlet of the pump and which at its other end defines a skirt portion 16. The skirt portion engages a hollow extension 16A which is held in sealing engagement with the flange 13 by means of a cap nut 17 the latter being in screw thread engagement with the body portion 14 and having an aperture in its base wall through which the body 12 extends.

Formed in the valve body is an axial bore 18 which at its end adjacent the free end of the body 12, is enlarged to define a seating 19 of truncated conical form followed by a generally right cylindrical portion 20. Slidable in the bore 18 is a valve member which includes a stem 21 of smaller diameter than the bore 18. The stem has a fluted portion 22 and a cylindrical portion 23, these two portions co-operating with the wall of the bore 18 to guide the movement of the valve member. In addition, the valve stem carries a valve head 24 which is shaped to co-operate with the seating 19 and which defines an annular clearance with the cylindrical portion 20. In addition, the stem extends out of the opposite end of the bore and carries a hollow flanged spring abutment 25 which is retained relative to the stem by means of a retainer 26. Located between the spring abutment 25 and the flange 13 is a first resilient means in the form of a coiled compression spring 27. The interior of the skirt is connected by passages to the inlet 15 and the annular clearance defined between the valve stem and the wall of the bore 18 communicates with the chamber which contains the spring by way of inlet openings 28 which are formed in the body 12.

The portion of the nozzle thus far described is well known in the art and in operation, when fuel under pressure is supplied to the inlet the fuel pressure acts upon the valve member to move the valve member against the action of the spring 27 and the valve head 24 is lifted from the seating 19 to allow fuel flow through the annular clearance defined between the valve head 24 and the cylindrical portion 20 downstream of the seating 19. The extent of movement of the valve member is determined by the abutment of the sleeve 25 with the body 12. In addition, the valve head is contoured so that the effective area of the aforesaid annular clearance varies as the valve head moves away from the seating.

The nozzle also includes a further coiled compression spring 29 and this is housed within a cylindrical chamber 30 which is defined in an insert 31 which is screwed into position in the skirt portion 16. The insert 31 is provided with passages 32 and ports 32A to permit fuel flow from the inlet 15 to the openings 28. The spring 29 constitutes a second or further resilient means and it engages a spring abutment 33 which is formed with an integral push piece 34 which is slidable within a bore 35 formed in the insert. The push piece extends into contact with the end of the stem 21 of the valve member and in the closed position of the valve member a small clearance indicated by the letter S exists between the abutment 33 and the end wall of the chamber 30. The spring 29 exerts less force upon the abutment 33 than the force exerted by the spring 27 upon the valve stem 21. The valve member can therefore assume the closed position in which it is shown, with the valve head 24 being in contact with the seating 19. The force exerted on the valve stem in the closed position is the difference between the forces exerted by the springs 27 and 29.

When fuel under pressure is supplied to the inlet 15 the force exerted by the fluid pressure lifts the valve member from the seating as described. The fuel pressure required to effect the initial movement is less than if an identical spring 27 alone acted upon the valve member. It is arranged that the spring 27 is stiffer than in a comparable nozzle not having the spring 29, so that the nozzle opening pressure is substantially the same. As the valve member lifts from its seating the spring 29 will continue to assist such movement until the abutment 33 contacts the end wall of the chamber 30. Once this has occurred the continued movement of the valve member is against the force exerted by the spring 27 and an increase in fuel pressure is required. The fuel pressure does however act upon the push piece 34 which forms a piston means to oppose the action of the spring 29 and the practical effect of this arrangement is that the sharp transition which would occur if the push piece 34 did not constitute a piston, is modified.

The preload of the spring 29 can be adjusted by moving an adjustable abutment 36 and the diameter of the push piece 34 can also be varied to adjust the force exerted against the action of the spring 29. It is arranged that the area of contact of the push piece 34 and the valve member is less than the crosssectional area of the end of the push piece, this conveniently being achieved by providing the valve member with a rounded end which locates in a complementary recess formed in the end face of the push piece, the area of the recess being less than the cross-sectional area of the end of the push piece.

The chamber 30 can be vented to the fuel inlet 15 to enable rapid closure of the valve member to take place when the pressure at the inlet falls. The venting is achieved through a one way valve shown as being part of the abutment 36, disposed to prevent flow of fuel from the inlet into the chamber 30 but to permit fuel flow in the opposite direction.

We claim:

1. A fuel injection nozzle for supplying fuel to a compression ignition engine, comprising, a casing;

a valve body mounted on said casing and having a spring retainer seat which engages said casing, said valve body including an opening for injecting fuel into an associated chamber of the compression ignition engine and a seating;

a first spring abutment means located within said casing adjacent to said valve body;

a first spring located between said spring retainer seat and said first spring abutment;

a valve stem slidably located within said valve body and said first spring abutment member and including on one end thereof a valve head engageable with said valve body seating and on another end thereof a retainer means engaging said valve body first spring abutment on a side of said spring abutment which is opposite to said first spring, said first spring being arranged to bias said valve head toward engagement with said valve body seating;

fuel passage means in said casing fluidly connecting said valve head to a fuel injection pump for conducting fuel to said head to move said head away from said seating against the bias of said first spring;

nozzle opening control means for controlling movement of said valve head away from said valve body seating, said control means including an insert member mounted on said casing, a spring chamber within said insert member, a second spring located within said spring chamber, a piston having a piston head located in said srping chamber in contact with said second spring and a body extending out of said spring chamber and having an end which is located in said fuel passage means, said piston end having a portion thereof in contact with said stem to transfer force from said second spring to said stem, said second spring being arranged to bias said valve head away from engagement with said valve body seating, said piston end having another portion which is exposed to fuel pressure in said fuel passage means and being located and positioned so that fuel pressure biases said piston in a direction opposite to the bias exerted on said piston by said second spring; and isolation means on said insert member spring chamber for isolating said piston head from fuel pressure in said fuel passage means so that piston movement caused by said second spring is only opposed by fuel pressure acting on said piston end another portion and by the bias exerted by said first spring.

2. A nozzle according to claim 1, including an adjustable abutment on said casing for said second spring, said isolation means being mounted in said abutment.

3. The fuel injection nozzle as claimed in claim 1 wherein said valve stem includes a convex end and said piston end portion includes a recess complementary to said stem convex shape with said stem end another portion surrounding said stem end convex shape.

4. The fuel injection nozzle as claimed in claim 3 wherein said piston head is spaced from the walls of said spring chamber when said valve head is in engagement with said valve body seating.

5. The fuel injection nozzle as claimed in claim 4 wherein said isolation means includes a one-way valve.

* * * * *